United States Patent [19]

Iwata et al.

[11] Patent Number: 4,944,271

[45] Date of Patent: Jul. 31, 1990

[54] CONTROLLER FOR INTERNAL COMBUSTION ENGINE

[75] Inventors: Toshio Iwata; Satoru Ohkubo, both of Hyogo, Japan

[73] Assignee: Mitsubishi Denki Kabushiki Kaisha, Tokyo, Japan

[21] Appl. No.: 334,505

[22] Filed: Apr. 7, 1989

[30] Foreign Application Priority Data

Apr. 13, 1988 [JP] Japan ..... 63-92165

[51] Int. Cl.[5] ..... F02M 51/00

[52] U.S. Cl. ..... 123/435; 123/494; 123/425; 123/417

[58] Field of Search ..... 123/435, 425, 498, 616, 123/494, 417, 488; 73/35; 364/431.08

[56] References Cited

U.S. PATENT DOCUMENTS

| | | | |
|---|---|---|---|
| 4,660,535 | 4/1987 | Asano | 123/425 |
| 4,732,126 | 3/1988 | Ikeura et al. | 123/435 |
| 4,762,105 | 8/1988 | Beyer et al. | 123/417 |
| 4,773,375 | 9/1988 | Okino et al. | 123/488 |
| 4,819,490 | 4/1989 | Isobe et al. | 123/494 |

FOREIGN PATENT DOCUMENTS 85148 4/1987 Japan .

*Primary Examiner*—Raymond A. Nelli

*Attorney, Agent, or Firm*—Sughrue, Mion, Zinn, Macpeak & Seas

[57] ABSTRACT

This invention provides a controller for controlling the combustion of an internal combustion engine. The controller comprises pressure sensors for detecting the pressure in a set of cylinders. The detected pressure profile in the cylinders is used to determine the combustion parameters, based on which the drive control parameters are determined. The combustion of the engine is normally controlled with those drive control parameters while the control is performed by means of predetermined parameters in the event of no combustion occurring. In determining the combustion parameters, the controller in accordance with this invention calibrates the pressure profile detected by the pressure sensor to eliminate the modulus and the offset of the pressure sensor from the pressure profile. The modulus and the offset are renewed on a proper basis to make up for the drawback that the modulus and the offset fluctuate in response to changes in temperature.

6 Claims, 3 Drawing Sheets

CONTROLLER FOR INTERNAL COMBUSTION ENGINE

TECHNICAL FIELD

This invention relates to a controller for controlling the combustion of an internal combustion engine.

BACKGROUND ART

A controller of the above-described type for an internal combustion engine controls the combustion of the engine on the basis of certain drive control parameters, such as the ignition timing and the air-fuel ratio, so as to optimize in terms of the driving performance the values and ranges of fluctuation of certain combustion parameters. These combustion parameters, include e.g. maximum combustion pressure $P_{max}$, crank angle $\theta P_{max}$ at the time of achieving the maximum combustion pressure $P_{max}$, maximum rise rate $dP/d\theta_{max}$ of the combustion pressure, and indicated mean effective pressure Pi. These combustion parameters are determined by the controller on the basis of the pressure profile in the cylinders of the engine which is detected by a pressure sensor.

A controller for an internal combustion engine of the above-described type is therefore required to accurately detect the pressure profile on which the control of the combustion is based.

However, since the pressure sensor is directly attached to the engine, it is subjected to significant changes in temperature, resulting in a conspicuous tendency to deteriorate with age. In view of this, as well as its initial instability, the detection of the pressure profile achieved by the sensor is in practice far from accurate.

As a result of the poor accuracy of the pressure profile, a controller for an internal combustion engine of the conventional type encounters difficulty in performing optimum control of the combustion of an engine at all times. Furthermore, a controller for an internal combustion engine of the conventional type is prone to inappropriately control the drive control parameters in an attempt to perform control on the basis of the detected pressure profile even when no combustion is occurring such as during cranking or a fuel cut.

SUMMARY OF THE INVENTION

It is an object of this invention to provide a controller for an internal combustion engine which performs optimum control of combustion on the basis of the pressure profile in the engine cylinders which is detected by a pressure sensor.

A controller for an internal combustion engine according to this invention comprises:

pressure detecting means for detecting pressure in the cylinders of the engine;

calibrating means including means for renewing the modulus and the offset of the pressure sensing means on a proper basis, means for calibrating the output from the pressure sensing means on the basis of the renewed modulus and offset of the pressure sensing means to reveal the actual pressure profile in the cylinders, and means for determining the combustion parameters of the engine on the basis of the calibrated pressure profile; and control means including means for determining the drive control parameters of the engine on the basis of the combustion parameters, and means for controlling combustion of the engine normally on the basis of the drive control parameters and, in the event of occurrence of no combustion occurring, on the basis of predetermined parameters.

In an embodiment of this invention, a piezoelectric element is employed as the pressure sensing means. As is known to those skilled in the art, a piezoelectric element has a peculiar piezoelectric modulus and a peculiar offset that need to be removed from the output from the element in order to reveal the actual pressure. However, as was mentioned before, since both the modulus and the offset make peculiar changes and fluctuate in response to changes in temperature of the element, it is necessary to know what they are at the time of detection in order to determine what the actual pressure is, that is, they need to be renewed on an appropriate basis.

In the embodiment, the controller further comprises a manifold pressure sensor for detecting the manifold pressure of the engine. The means for renewing the modulus and the offset of the pressure sensing means will determine the offset by comparing the pressure in the cylinders as detected by the pressure sensing means at any time during the intake stroke with the manifold pressure as detected by the manifold pressure sensor.

The controller of the embodiment further comprises a crank angle sensor for detecting the crank angle of the engine. The means for renewing the modulus and the offset of the pressure sensing means will determine the modulus by comparing the pressure in the cylinder, as detected by the pressure sensing means at the time when the crank is at the top dead center position as detected by the crank angle sensor, with the product of the compression ratio of the engine and the manifold pressure as detected by the manifold pressure sensor.

The peculiar temperature characteristic of a piezoelectric element is taken into consideration when the modulus is determined. The controller of the embodiment further comprises a temperature sensor for detecting the temperature of the pressure sensing means. The means for renewing the modulus and the offset of the pressure sensing means will determine the modulus more accurately by multiplying the calculated product by the temperature characteristic of the pressure sensing means and any change in temperature of the pressure sensing means as detected by the temperature sensor.

BRIEF DESCRIPTION OF THE DRAWINGS

The invention will be described in more detail with reference to the drawings, of which.

DETAILED DESCRIPTION OF THE INVENTION

Figure 1:
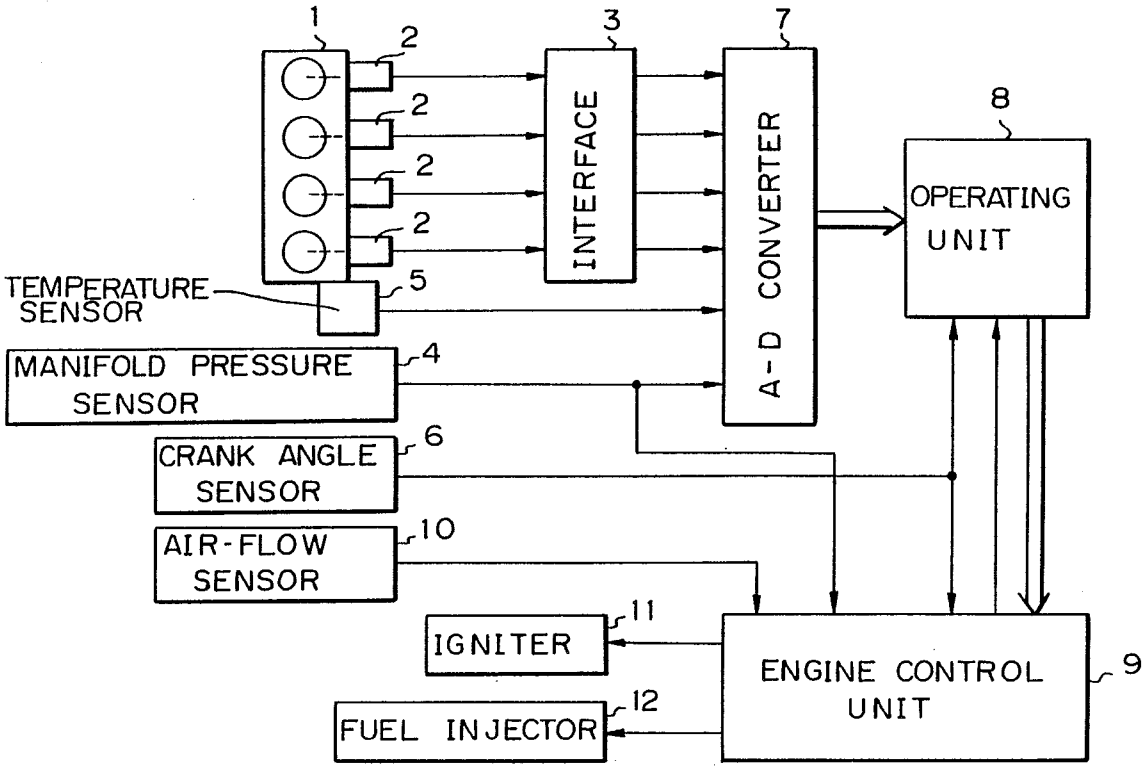
FIG. 1 is a schematic view showing a control unit employed in an embodiment of this invention.

Referring to FIG. 1, reference numeral 1 denotes an internal combustion engine (which is hereinafter simply termed "an engine" for ease of reference) having four cylinders with a pressure sensor 2 provided to each of the cylinders.

Numeral 3 denotes an interface circuit for converting received signals from the sensors 2 in the cylinders into voltage signals.

Numeral 4 denotes a manifold pressure sensor for detecting the manifold pressure of the engine 1, numeral 5 denotes a temperature sensor located at the same site as or as close as possible to the pressure sensor 2, numeral 6 denotes a crank angle sensor for detecting the crank angle of the engine, numeral 7 denotes an Analog-Digital converter (which is hereinafter simply termed "A/D converter") for converting voltage signals from the interface circuit 3, the manifold pressure sensor 4 and the temperature sensor 5 into digital signals.

Numeral 8 denotes an operating unit for determining the combustion parameters from the pressure profile in the cylinders on the basis of signals from the A/D converter 7 and the crank angle sensor 6.

Numeral 9 denotes an engine control unit for calculating the drive control parameters, such as the ignition timing and the air fuel ratio, on the basis of outputs from an airflow sensor 10 for detecting intake air flow, the crank angle sensor 6, the manifold pressure sensor 4 and the operating unit 8, which parameters are then supplied as an ignition signal and a fuel injection signal.

Numeral 11 denotes an igniter and numeral 12 denotes a fuel injector, which receive the ignition signal and the fuel injection signal from the engine control unit 9 and then actuate the respective devices of the igniter 11 and the injector 12 to perform engine ignition and fuel injection.

Figure 2:
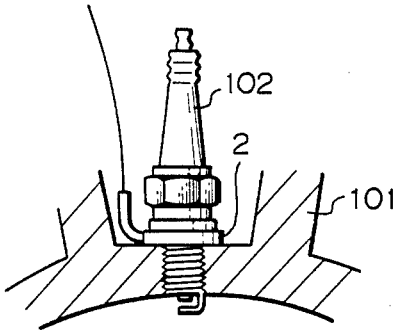
FIG. 2 is a fragmentary cross-sectional view showing the mounted state of a sensing means in a cylinder employed in the above embodiment.

The pressure sensor 2 may be a piezoelectric type sensor in the shape of, for example, a ring, which is, as shown in FIG. 2, disposed between the igniter 102 and the cylinder head 101 at the location where a top wall of the cylinder of the engine 1 is defined. The pressure sensor 2 of piezoelectric type provides an electrical charge in an amount proportional to the magnitude of pressure in the cylinder. The interface circuit 3 is therefore adapted to convert electrical charges into voltage signals when used with the sensor 2 of piezoelectric type.

Figure 3:
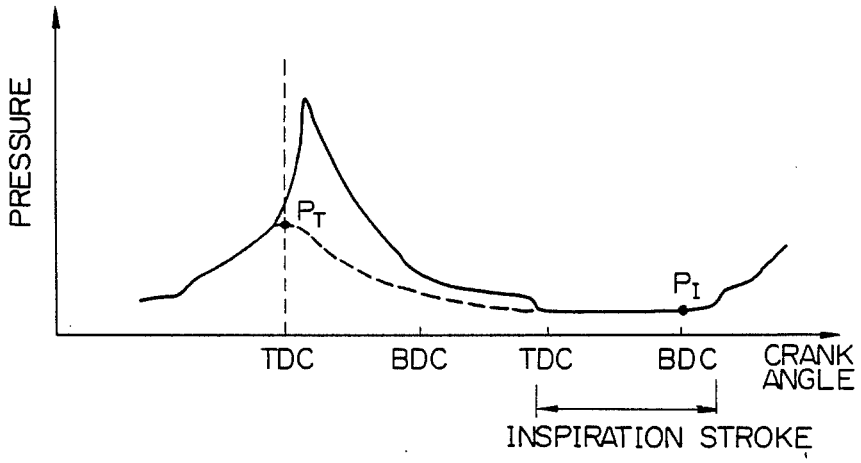
FIG. 3 is a graph showing a pressure profile in a cylinder.

Reference is now made to FIG. 3 showing a pressure profile in a set of cylinders so as to explain the operation of the controller. The pressure profile in a set of cylinders should be determined in consideration of the modulus and the offset of the pressure sensors 2. As was mentioned before, the modulus and the offset are unstable for the aforementioned reasons and should be renewed so as to reveal the actual pressure profile in the cylinders. This invention provides a method of renewing the modulus and the offset, which will be explained below.

During the intake stroke illustrated in FIG. 3, inlet valves are opened and the pressure in the cylinders is equal to that in the induction manifold. The offset of the sensors 2 is therefore formed by comparing the pressure detected by the pressure sensor 2 with the pressure PI detected by the manifold pressure sensor 4 at any time during the intake stroke, for example, at the time when the crank is at bottom dead center (BDC) during the intake stroke which is sensed by the crank angle sensor 6. This renewing of the offset of the pressure sensor 2 can be carried out while the engine 1 is in operation.

The method of renewing the modulus of the pressure sensor 2 will now be explained.

In the event of no combustion occurring in the cylinders due to lack of pressure consequent upon the previous combustion, the pressure profile in the cylinders follows the phantom line illustrated in FIG. 3, whereby the pressure in the cylinders attains a maximum level PT at the time of top dead center (TDC). The maximum pressure PT in the event of no combustion occurring is thought to be the product of the pressure in the cylindes during the intake stroke, that is, the manifold pressure PI and the compression ratio $\epsilon$ of the engine which is predetermined in advance ($PT=\epsilon \cdot PI$)

The drive contral unit 9 detects the condition of no combustion, such as at the time of cranking the engine 1 when being started or at the time of a fuel cut during deceleration. During the time when no combustion is occurring, the modulus of the pressure sensors 2 is renewed on the basis of the above calculation made at the time of TDC as sensed by the crank angle sensor 6.

The pressure sensor 2 has a temperature characteristic which could affect its capacity to detect pressure accurately when temperature of the pressure sensor 2 changes because of changes in the condition in which the engine 1 is being driven. To eliminate this influence of the temperature characteristic upon the result of the detection performed by the sensor 2, the operating unit 8 makes a modification of the result of the above calculation ($PT=\epsilon \cdot PI$) by utilizing the product of the result of the calculation and the temperature characteristic (k) of the sensor 2, which known in advance, as well as a temperature change ($\Delta t$) detected by the sensor 5 which is disposed as close as possible to the sensor 2 ($PT=k \cdot \Delta t \cdot \epsilon PI$).

With the modulus and the offset of the pressure sensor 2 renewed on a proper basis, exact measurement of the pressure in the cylinders can be effected during the time when the combustion is taking place in the cylinder.

The condition of no conbustion occurs, such as at the time of cranking the engine 1 when being started, at the time of a fuel cut during deceleration, or a fuel cut or ignition cut for the purpose of preventing overspeed. The determination of the proper drive control parameters could fail because of the combustion parameters being determined on the basis of the sensed pressure in the cylinders. Such improper drive control parameters could lead to the control of the drive control parameters deviating from the range of proper control and could contribute to a temporary failure in control of the engine 1 after combustion is restored.

The engine control unit 9 stops the control based on the drive control parameters which are determined in accordance with the combustion parameters supplied by the operating unit 8 when no combustion occurs. Instead, the engine control unit 9 performs control of the engine 1 on the basis of the predetermined parameters at this time.

Figure 4:
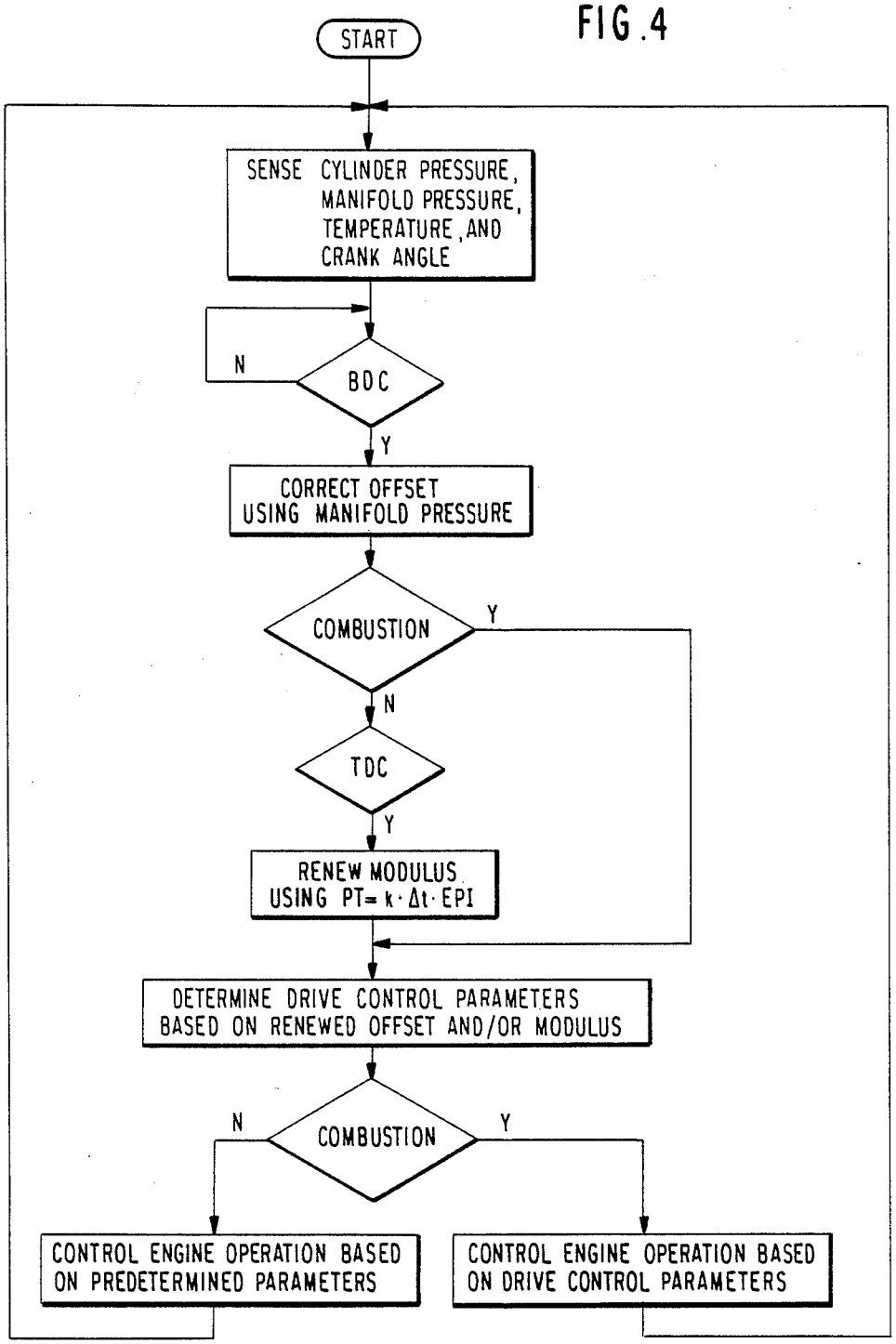
FIG. 4 is a flow chart summarizing operation of the invention.

FIG. 4 sets forth the sequence of steps involved in determining appropriate renewal of the modulus and offset of the pressure sensors 2, and in implementing the correct drive control parameters.

As has been explained, since the controller of this invention is designed to renew the modulus and the offset of the pressure sensor on a proper basis and to stop the control based on the drive control parameters determined on the basis of the combustion parameters, thereafter performing the control of the engine on the basis of the predetermined parameters instead, optimum control based on the pressure detected in the cylinders can be effected.

What is claimed is:

1. In a controller for an internal combustion engine operating on the basis of drive control parameters comprising:

pressure sensing means, having a variable transducing modulus and pressure offset between an actual pressure and a detected pressure in the cylinders of the engine, for detecting pressure in the cylinders of the engine and for generating an output representing a detected pressure profile;

calibrating means comprising (i) means for generating a renewed modulus and a renewed offset of said pressure sensing means, (ii) means for calibrating the output from said pressure sensing means on the basis of said renewed modulus and renewed offset of said pressure sensing means to produce a calibrated pressure profile in the cylinders, and (iii) means for determining the combustion parameters of the engine on the basis of said calibrated pressure profile; and control means responsive to said calibrating means comprising means for determining the drive control parameters of the engine on the basis of said combustion parameters, and means for controlling combustion of the engine normally on the basis of said drive control parameters but, in predetermined operating conditions of the engine, on the basis of predetermined parameters.

2. A controller as claimed in claim 1 further comprising a manifold pressure sensor for detecting the manifold pressure of the engine wherein said means for generating a renewed modulus and the offset of said pressure sensing means determines said offset by comparing a renewed pressure in the cylinders as detected by said pressure sensing means at any time during, the intake stroke, with the manifold pressure, as detected by said manifold pressure sensor.

3. A controller as claimed in claim 2 further comprising a crank angle sensor means for detecting a crank angle of at least one cylinder of the engine, and wherein said means for generating a renewed modulus and a renewed offset of said pressure sensing means determines said renewed modulus by comparing the pressure in said cylinder, as detected by said pressure sensing means at the time when said cylinder is in a top dead center position as detected by said crank angle sensor, with the product of the compression ratio of the engine and the manifold pressure, as detected by said manifold pressure sensor.

4. A controller as claimed in claim 3 further comprising a temperature sensor for detecting the temperature of said pressure sensing means wherein said pressure sensing means has a temperature characteristic and said means for generating a renewed modulus and a renewed offset of said pressure sensing means further determines said modulus by multiplying said calculated product by said temperature charactersitic of said pressure sensing means and the change in temperature of said pressure sensing means detected by said temperature sensor.

5. A method for controlling combustion of an internal combustion engine operating on the basis of drive control parameters and having a pressure sensing means with a variable transducer modulus and pressure offset between an actual pressure and a detected pressure in the cylinders of the engine, said pressure sensing means generating an output with a pressure profile, said method comprising the steps of:

detecting pressure in the cylinders of the engine with said pressure sensing means;

generating a renewed modulus and a renewed offset of said pressure sensing means;

calibrating the output from said pressure sensing means on the basis of said renewed modulus and renewed offset of said pressure sensing means to produce a calibrated pressure profile in the cylinders;

determining the combustion parameters of the engine on the basis of said calibrated pressure profile;

determining the drive control parameters of the engine on the basis of said combustion parameters; and controlling combustion normally on the basis of said drive control parameters but, in predeteremined operating condition of the engine, on the basis of predetermined parameters.

6. A method according to claim 5, further comprising the step of detecting a manifold pressure of the engine, said generating step being performed in accordance with an outcome of said detecting step.

* * * * *